US009803839B2

(12) United States Patent
Visser et al.

(10) Patent No.: US 9,803,839 B2
(45) Date of Patent: Oct. 31, 2017

(54) AIRTIGHT AND IC-RATED RECESSED LIGHT HOUSING

(71) Applicant: NUMBER EIGHT LIGHTING COMPANY, Cotati, CA (US)

(72) Inventors: Joel Visser, Petaluma, CA (US); Gary Cross, San Francisco, CA (US); David Gutting, Santa Rosa, CA (US)

(73) Assignee: Number Eight Lighting Company, Cotati, CA (US)

( * ) Notice: Subject to any disclaimer, the term of this patent is extended or adjusted under 35 U.S.C. 154(b) by 37 days.

(21) Appl. No.: 14/983,343

(22) Filed: Dec. 29, 2015

(65) Prior Publication Data

US 2017/0184285 A1 Jun. 29, 2017

(51) Int. Cl.

| | |
|---|---|
| ***F21V 21/26*** | (2006.01) |
| ***F21V 21/04*** | (2006.01) |
| ***F21V 21/30*** | (2006.01) |
| *F21S 8/02* | (2006.01) |
| *F21V 31/00* | (2006.01) |
| *F21V 29/74* | (2015.01) |
| *F21V 23/00* | (2015.01) |
| *F21V 7/00* | (2006.01) |
| *F21V 14/02* | (2006.01) |
| *F21V 29/89* | (2015.01) |

(52) U.S. Cl.

CPC ..... *F21V 21/047* (2013.01); *F21V 21/30* (2013.01); *F21V 23/008* (2013.01); *F21S 8/026* (2013.01); *F21V 7/0091* (2013.01); *F21V 14/02* (2013.01); *F21V 23/001* (2013.01); *F21V 29/74* (2015.01); *F21V 29/89* (2015.01); *F21V 31/00* (2013.01)

(58) Field of Classification Search

CPC ..... F21V 7/0016; F21V 21/26; F21V 21/30
USPC ..... 362/269
See application file for complete search history.

(56) References Cited

U.S. PATENT DOCUMENTS

| | | | | |
|---|---|---|---|---|
| 6,095,671 | A * | 8/2000 | Hutain | F21S 2/00 362/264 |
| 6,969,181 | B1 * | 11/2005 | Bailey | F21S 2/00 362/147 |
| 9,404,639 | B2 * | 8/2016 | Bailey | F21S 8/024 |
| 2010/0277905 | A1 * | 11/2010 | Janik | F21K 9/00 362/235 |

* cited by examiner

*Primary Examiner* — Ahshik Kim
(74) *Attorney, Agent, or Firm* — Craig M. Stainbrook; Stainbrook & Stainbrook, LLP

(57) ABSTRACT

An IC-rated airtight luminaire including a housing divided on a vertical plane to form two housing portions releasably coupled to one another to form an open cylindrical lower portion, a heat sink upper housing portion, and a heat conducting lamp assembly adjustment track enclosed within the housing. Disposed within the housing are heat sink walls slidably capturing a slide portion of a lamp assembly. A lamp holder integral with the slide bar includes a lens that directs a beam of light through an opening in a ceiling substrate in which the housing is installed, and an expansion ring rotatingly disposed around the open cylindrical lower portion of the housing engages and secures the housing in a ceiling substrate while also permitting the housing to freely turn within the expansion ring so as to allow adjustment of a beam of light directed from the lamp assembly.

20 Claims, 18 Drawing Sheets

AIRTIGHT AND IC-RATED RECESSED LIGHT HOUSING

CROSS REFERENCES TO RELATED APPLICATIONS

Not applicable. The present application is an original and first-filed United States Non-Provisional (Utility) Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention

The present invention relates most generally to lighting apparatus, and more particularly to recessed lighting, and still more particularly to an IC-rated and airtight recessed light housings.

Background Discussion

Recessed lighting may be installed at the time of construction prior to ceiling installation or as part of a remodel job after ceiling installation. In either case, a portion of the recessed lighting fixture generally occupies a space partly through the ceiling material, but the principal portion occupies a space above the plane of the ceiling substrate backside. Remodel recessed lighting involves creating a hole for the light housing, connecting the lamp portion of the light to a power source, and securing the housing within the hole, typically with bar hangers that fasten to framing members or with spring-based clamps that sandwich the ceiling substrate between a flange or ring circumscribing the housing.

As is well known, lamps, whether illuminated using low energy LED or conventional incandescent lamp sources, create and radiate considerable heat. Thus, housings have been devised to absorb and dissipate heat and, if not airtight, to allow heated air to escape the housing at a safe rate and in predetermined amounts, not to exceed specified upper limits. Such limits are defined and imposed by codes and regulations promulgated for safety and are published for industry review and compliance by standards organizations, such as the International Electrotechnical Commission and ASTM International, and safety and certification companies for electrical devices and components, such as UL LLC, the OSHA NRTL laboratories.

The most pertinent standards for the present invention can be found embodied in ASTM e283, which governs rate of air leakage through windows, curtain walls, and doors; IEC 60598-1:2014, which specifies general requirements for luminaires, incorporating electric light sources for operation from supply voltages up to 1,000 V, and sets standards for luminaires suitable for direct mounting in or on normally flammable surfaces when thermally insulating material may cover the luminaire; and UL 1598, which sets safety standards for luminaires. The IEC 60598 separates luminaires into two classes: (1) those for recessing into ceilings having thermal insulating material covering the luminaire (IC-rated); and (2) those for recessing into ceilings but not suitable for covering with thermal insulating material (non-IC-rated).

Under the applicable standards identified above, a light fixture may be rated for direct contact with insulation, and thus may bear an "IC" rating, only if it is approved for zero clearance insulation cover by an OSHA NRTL laboratory," such as UL. Because many homes have blown cellulose insulation covering light fixtures, an IC rating is essential for the safe use of recessed lighting. Where a non-IC light fixture is installed in a space (typically an attic or other space above a ceiling) that contains insulation, at least 3 inches of clearance must be provided on all sides of the luminaire.

A certified air tight luminaire is generally defined under the standards as one showing air leakage less than 2.0 CFM at 75 Pascals when tested in accordance with the ASTM E283 testing method. More colloquially, airtight means that the luminaire housing will not allow air to escape into the ceiling or attic space above the ceiling. This reduces heat loss and cool air loss.

Because conduction is a more efficient method of heat transfer than convection, it would be advantageous to include a lamp assembly that comprises the structures most directly and significantly heated in a recessed lighting luminaire, it would be advantageous to facilitate heat flow from the heat source as directly to the heat sink as possible. A solid-to-solid contact from lamp assembly components to a conductor also in solid-to-solid contact with the heat sink would be advantageous.

At present, there are no known IC-rated, certified airtight luminaires having a lamp assembly in direct physical contact with the housing, wherein the housing and heat sink assembly are also integrally formed, such that the housing functions as both the mounting structure for the lamp assembly and the heat sink so as to maximize heat flow through and away from the luminaire.

Further, known prior art luminaires having means for adjusting the angle of the illumination source either affix the lamp holder assembly to the trim components of the luminaire, or entail changing the angle of the luminaire housing, thereby requiring that the housing tip relative to the plane of the upper surface of the ceiling, and thereby render it at least impracticable to use in an insulated space or in ceiling substrates of any substantial thickness, or configure the assembly with at least a portion of the light engine disposed below the ceiling plane.

Still further, known IC-rated airtight luminaires require a double shroud to achieve the ratings and/or to provide gimbal ring type light adjustment, which is the only kind provided that has the feature wherein the light engine is entirely recessed from the plane of the ceiling. Moreover, the outer shroud is often larger than the ceiling opening, requiring that the luminaire be installed prior to ceiling installation.

BRIEF SUMMARY OF THE INVENTION

The present invention is an IC-rated, certified airtight luminaire that maximizes heat transfer from the lamp assembly to the heat sink and then out to surrounding atmosphere.

It is therefore a principal object of the present invention to provide an IC-rated and airtight lighting fixture installed from below a ceiling (a remodel-type housing) that does not require a second shroud.

An additional object of the present invention is to provide a three piece luminaire that functions as a housing, heat sink, and lamp module.

A still further object of the present invention is to provide a luminaire that rotates about a horizontal plane but does not rotate on any vertical plane, and therefore may be installed in a ceiling substrate of any thickness.

Yet another object of the present invention is to provide a luminaire having a mounting frame with a clamp design that enables attachment to a ceiling substrate of any thickness.

Another objection of the present invention is to provide a luminaire having a light engine entirely recessed above the ceiling plane.

A further object of the present invention is to provide a luminaire using trim plates secured by neodymium magnets.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
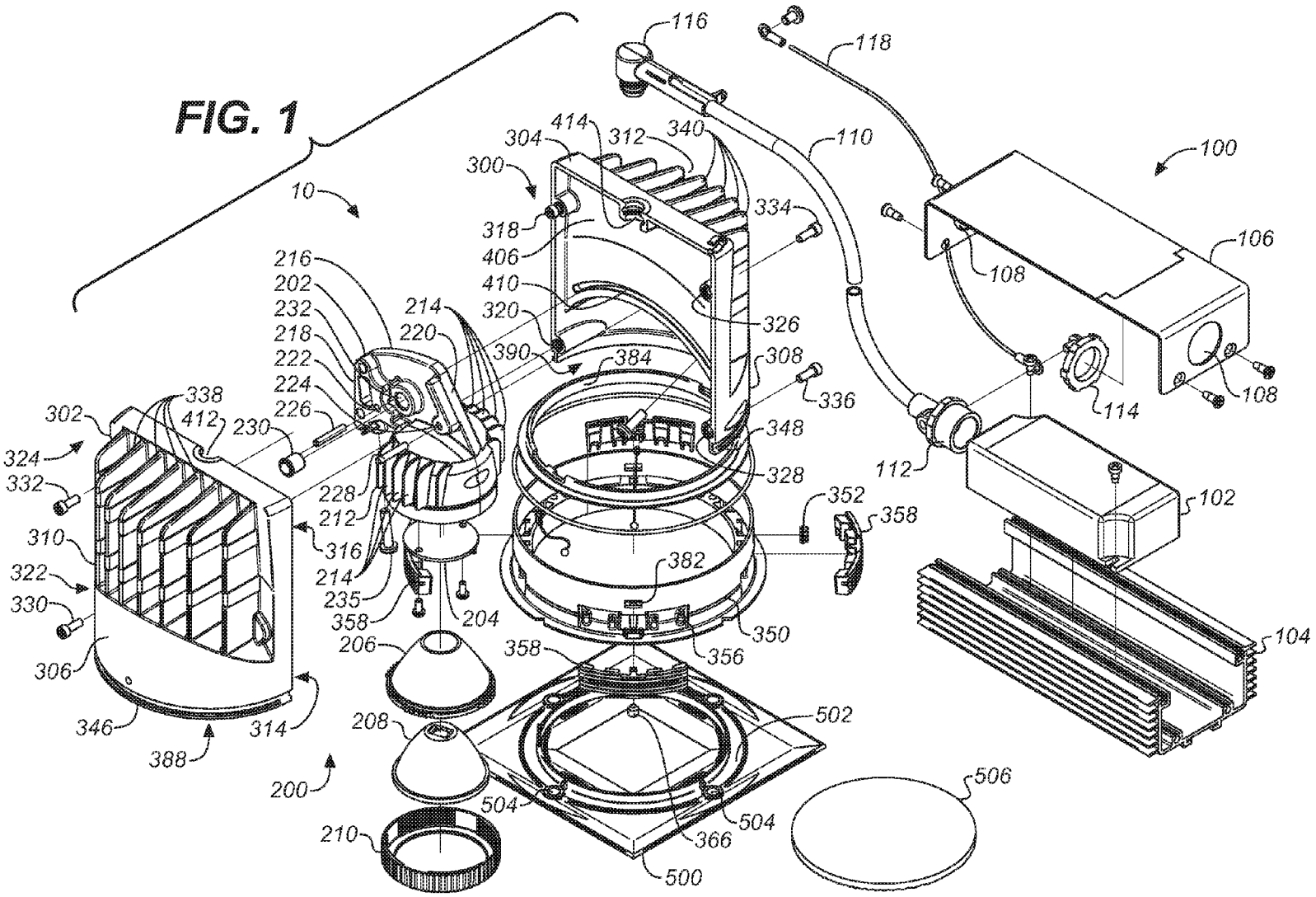
FIG. 1 is an exploded upper perspective view of the IC-rated airtight luminaire of the present invention.
Figure 2A:
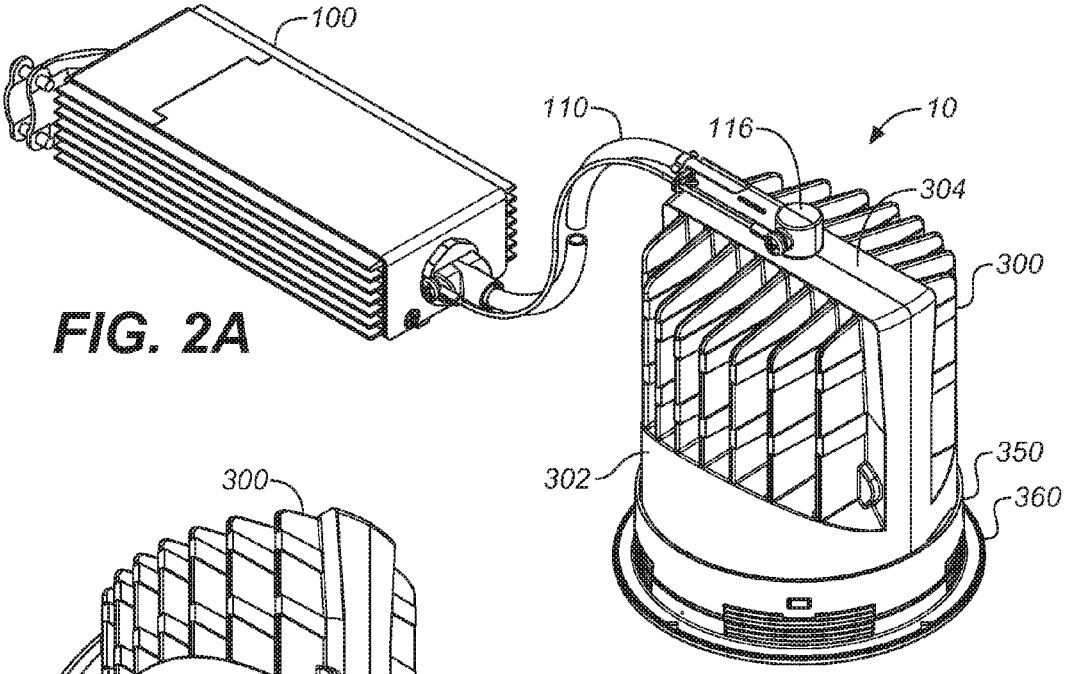
FIG. 2A is an upper perspective view thereof showing the luminaire assembled.
Figure 2C:
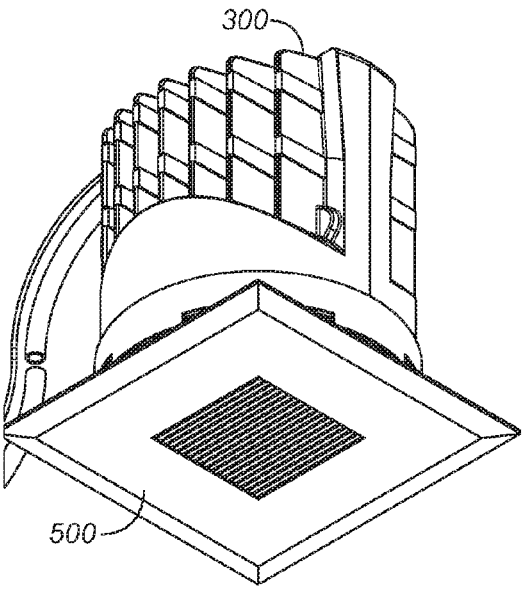
FIG. 2C is a lower perspective view showing the luminaire with an alternative, square, trim assembly, showing the LED driver and junction box removed.
Figure 2B:
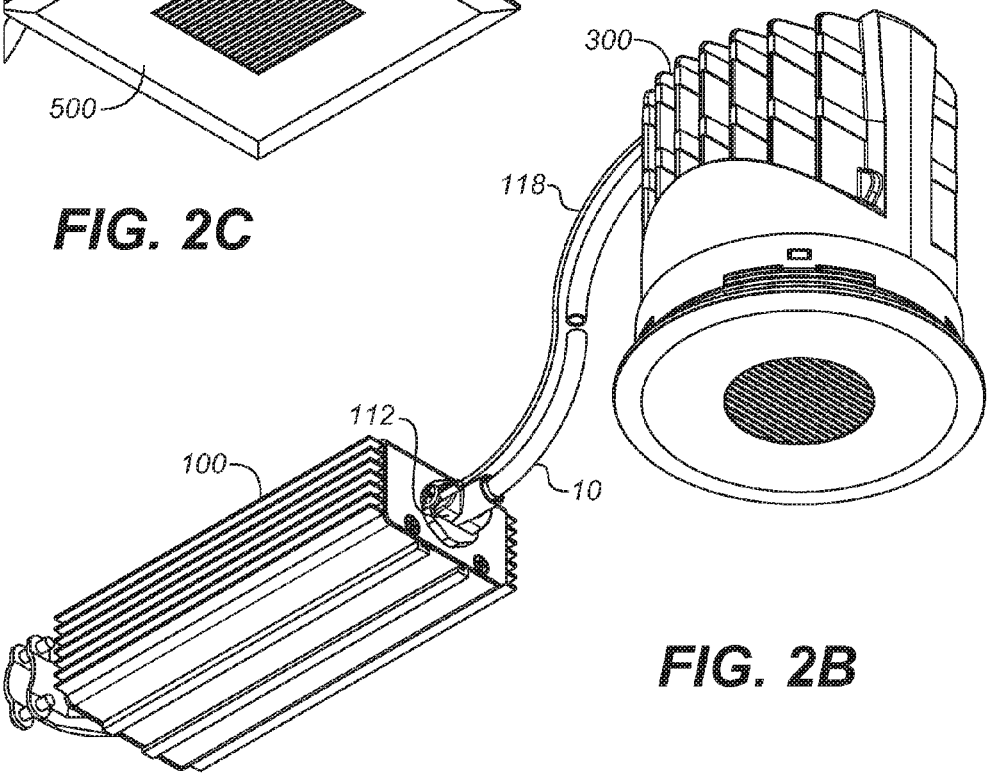
FIG. 2B is a lower perspective view thereof, shown with a round trim assembly installed.
Figure 3:
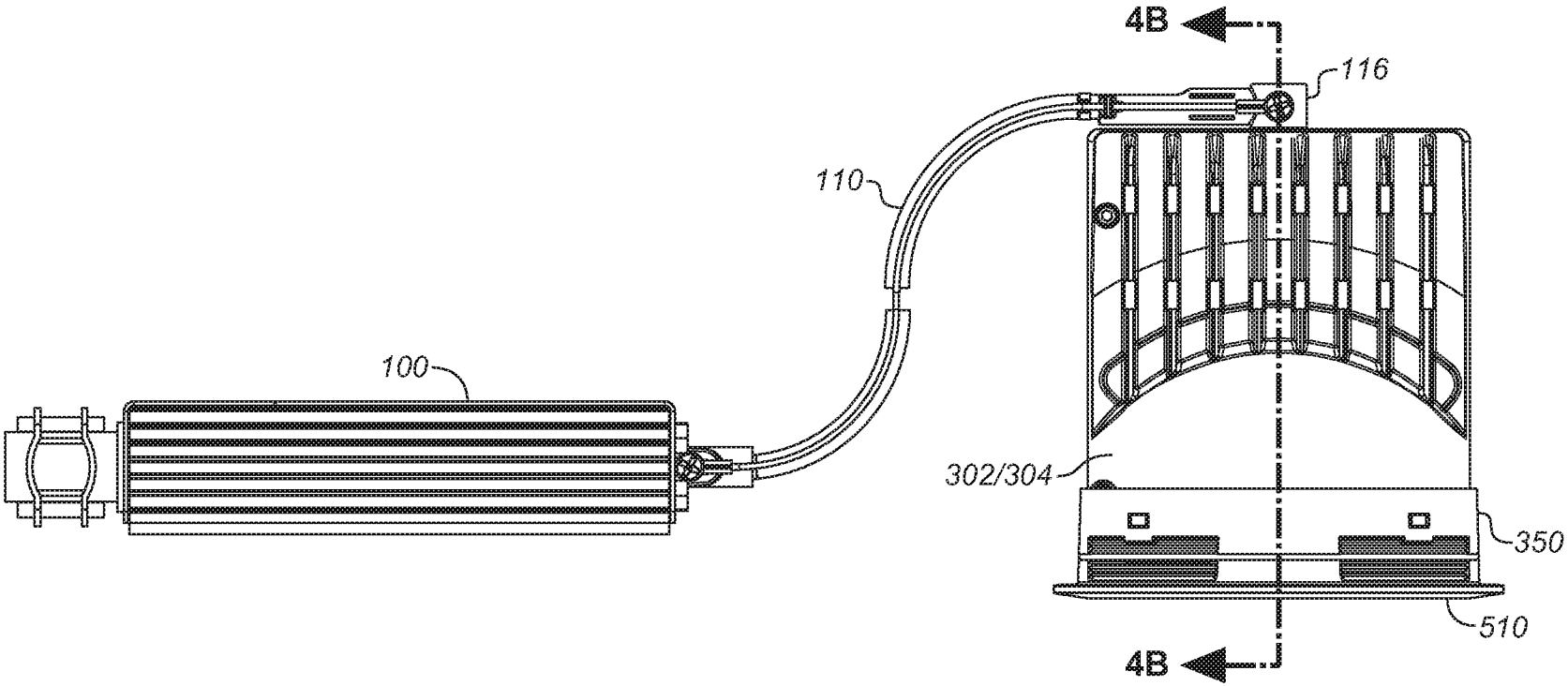
FIG. 3 is a side view in elevation of the luminaire of FIGS. 1-2B.

Referring to FIGS. 1 through 15B, wherein like reference numerals refer to like components in the various views, there is illustrated therein a new and improved IC-rated airtight luminaire, generally denominated 10 herein. Referring first to FIG. 1, there are shown the principal components of the inventive recessed light, which include a power supply and LED driver assembly 100, a lamp assembly 200, and a housing assembly 300.

The power assembly includes an LED driver 102 enclosed in an inline junction box 104 and covered by a junction box cover 106 having one or more knockouts 108. A flexible wire conduit 110 is coupled at one terminal end to the junction box cover using an electrical metallic tubing (EMT) connector 112 secured by an EMT nut 114. At a second end the flexible wire conduit terminates in a conduit swivel 116, which is pivotally attached to the center of the top of the luminaire housing in a manner described in detail below. The conduit swivel includes a cylindrical coupler 117 having a medial raised ring 119. Conductors (leads in a woven or braded insulating sheath, not shown) pass from the LED driver through the conduit to provide power to the lamp assembly. A support cable 118 may be provided for additional strength.

Figure 4B:
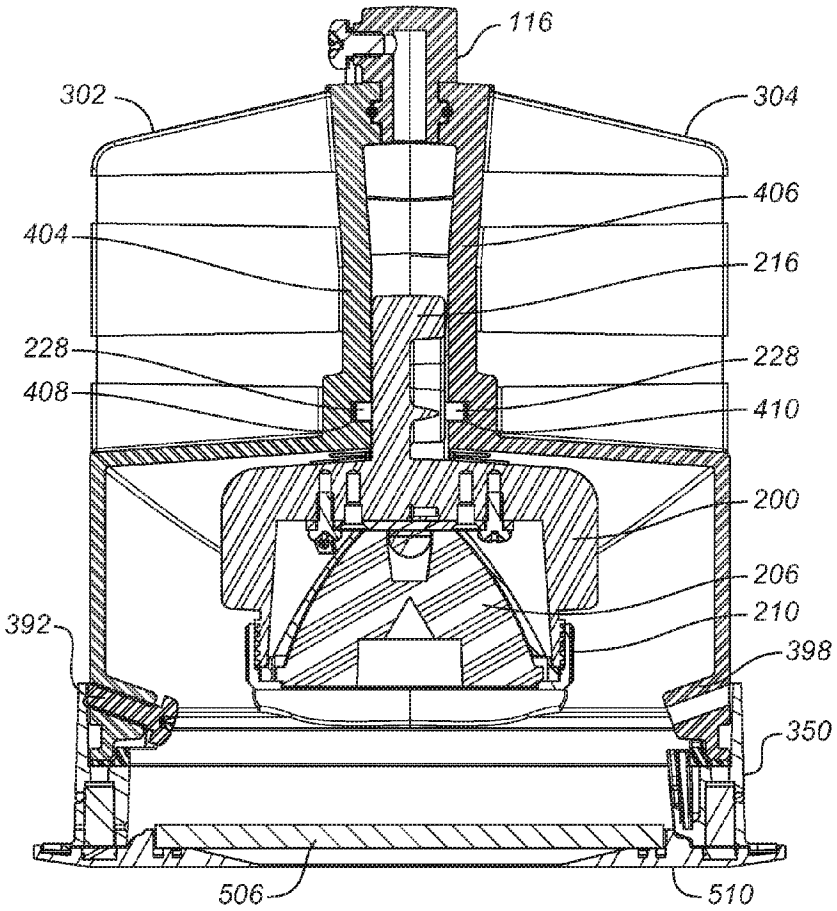
FIG. 4B is a cross sectional side view in elevation taken along section line 4B-4B of FIG. 3.
Figure 4A:
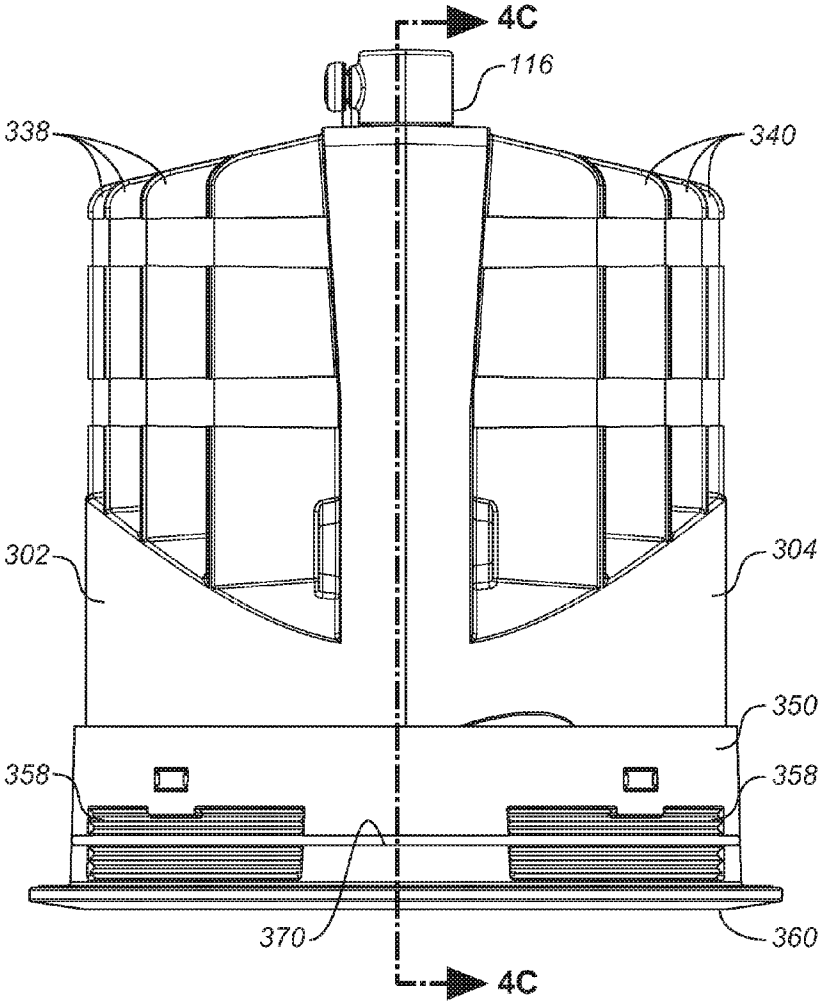
FIG. 4A is a side view in elevation of the housing portion of the inventive luminaire.
Figure 4D:
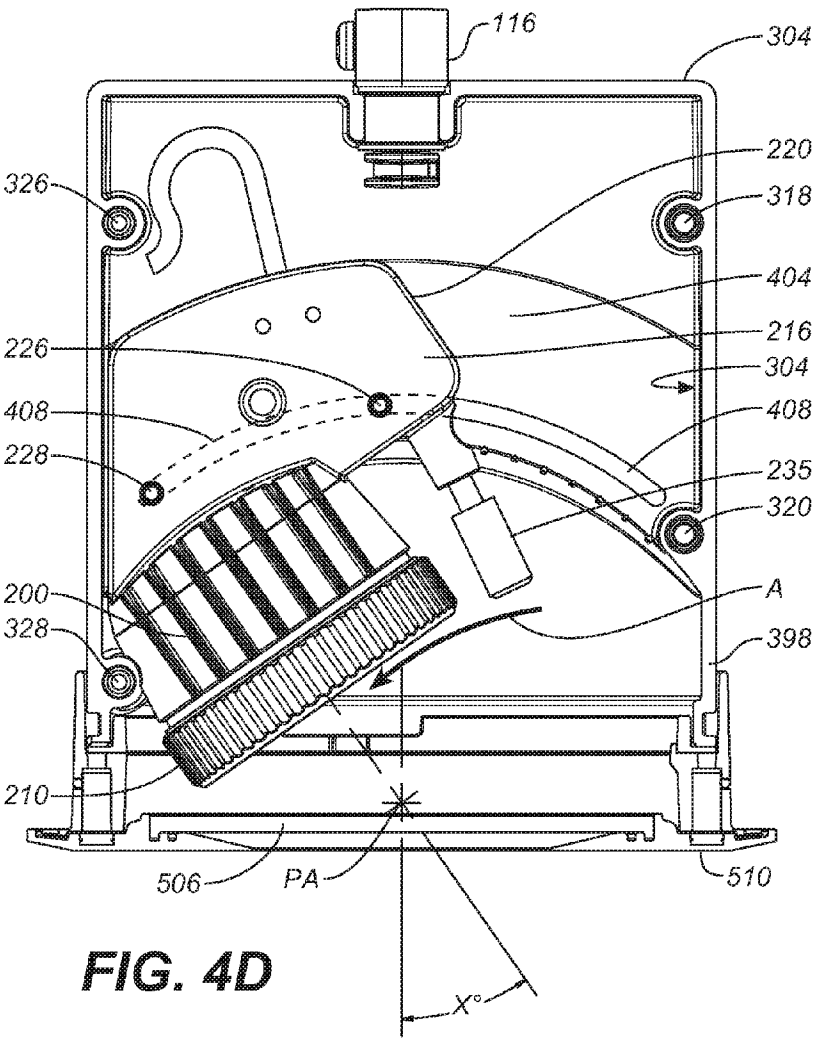
FIG. 4D is the same view showing the lamp assembly fully tilted to one side while maintaining a beam center in the identical location
Figure 4C:
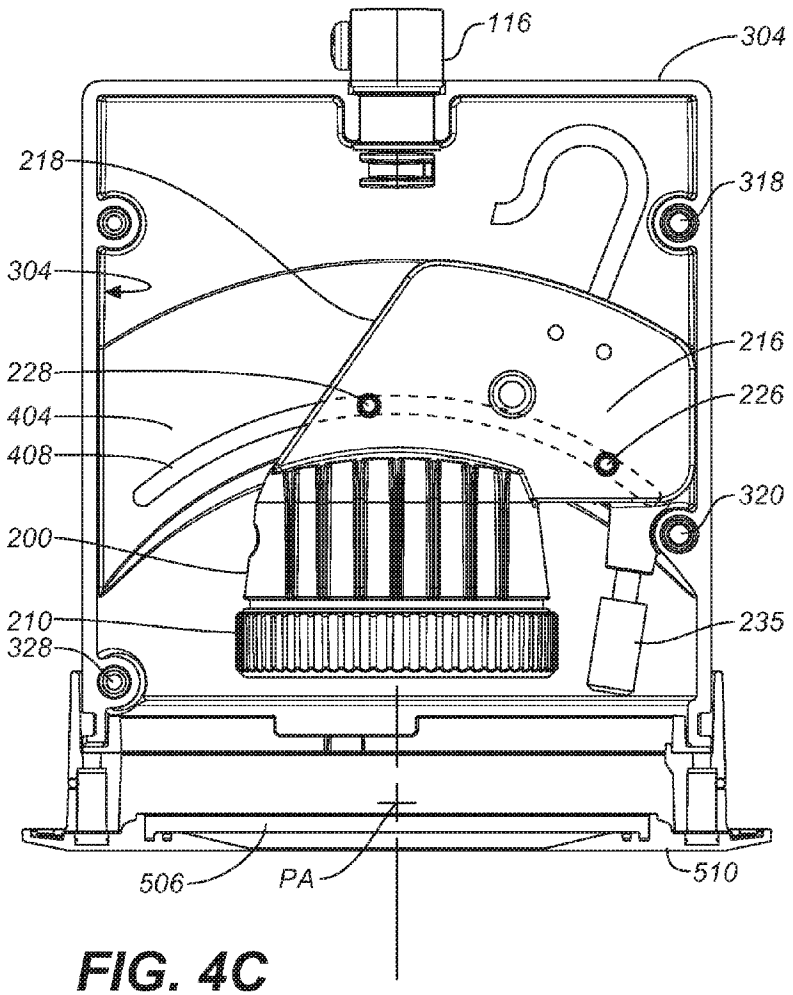
FIG. 4C is a cross sectional side view in elevation taken along section line 4C-4C of FIG. 4A, showing the mechanism for adjustably tilting the lamp assembly, with the lamp directing its beam directly downward.
Figure 5:
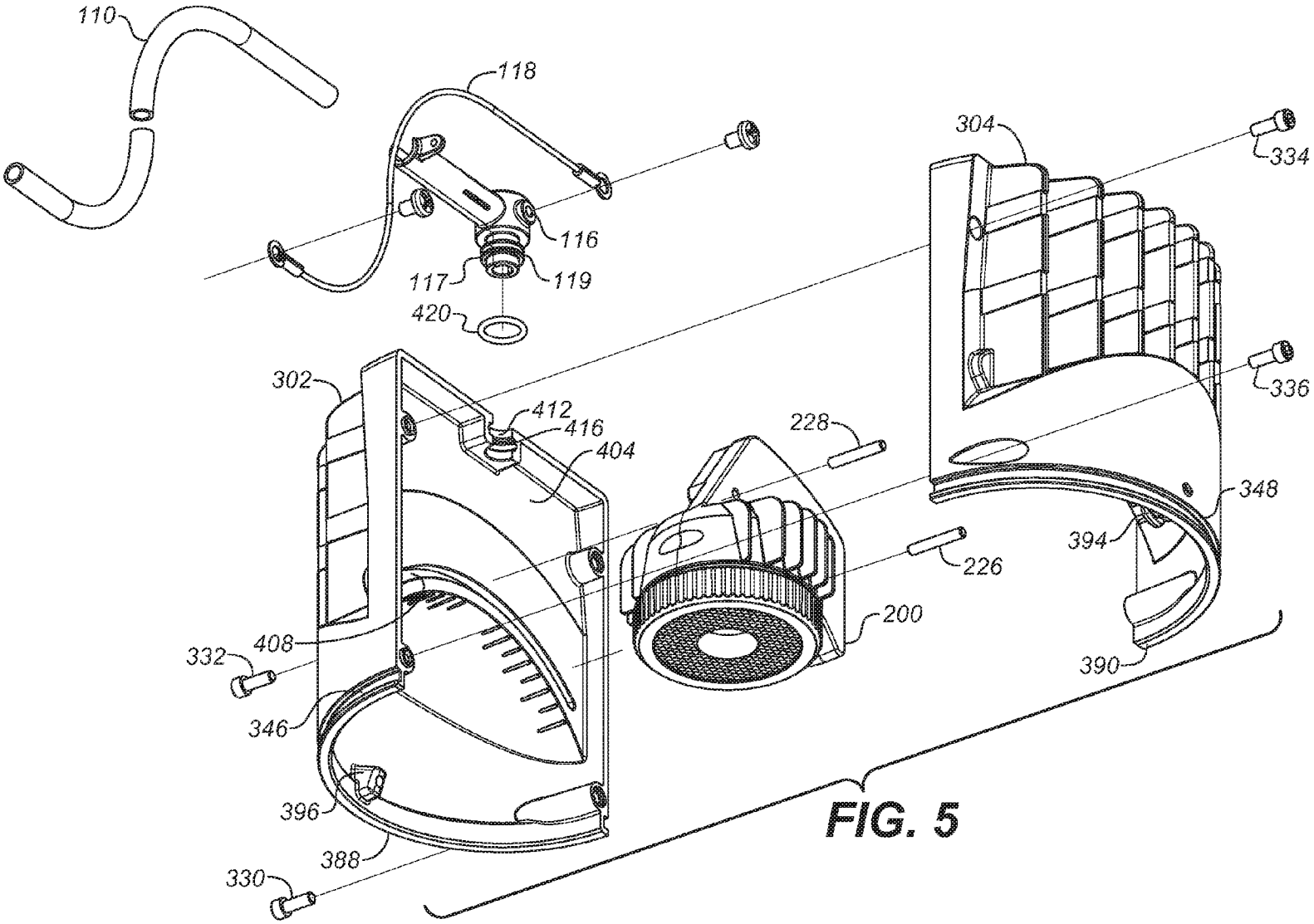
FIG. 5 is an exploded lower perspective view of the housing assembly of the luminaire, showing the lamp assembly enclosed therein and the connector cable.
Figure 6B:
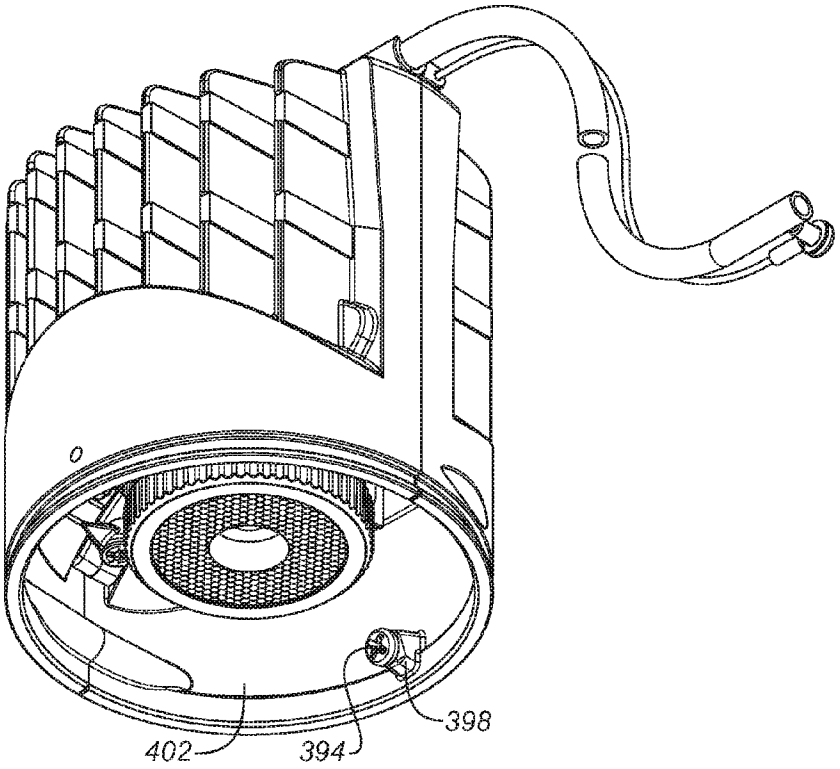
FIG. 6B the same view with the housing rotated approximately 90 degree.
Figure 6A:
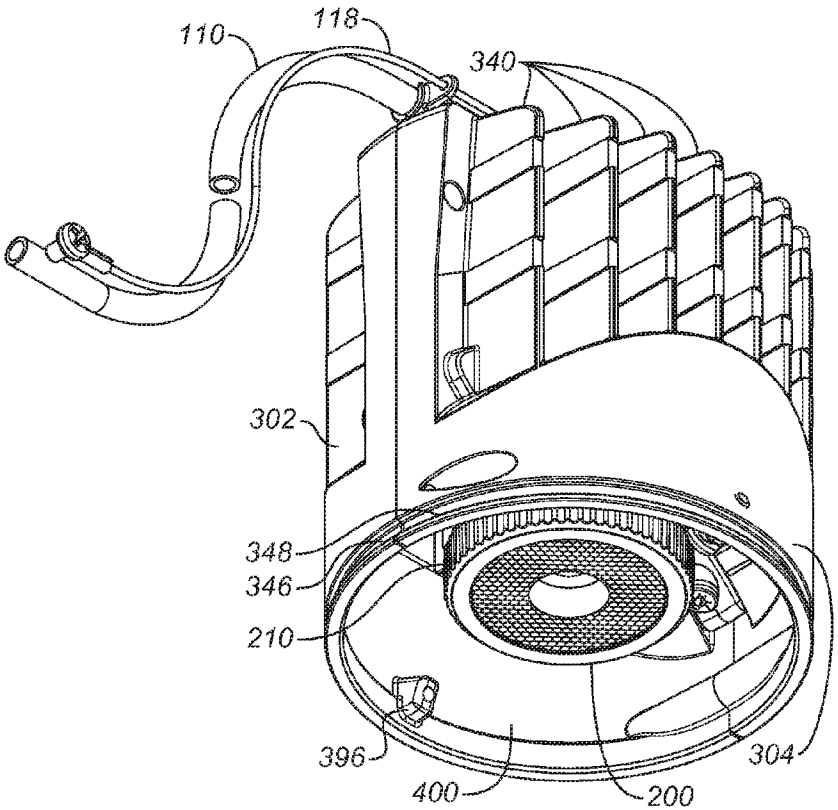
FIG. 6A is a lower perspective view showing the assembled housing and lamp assemblies.
Figure 7:
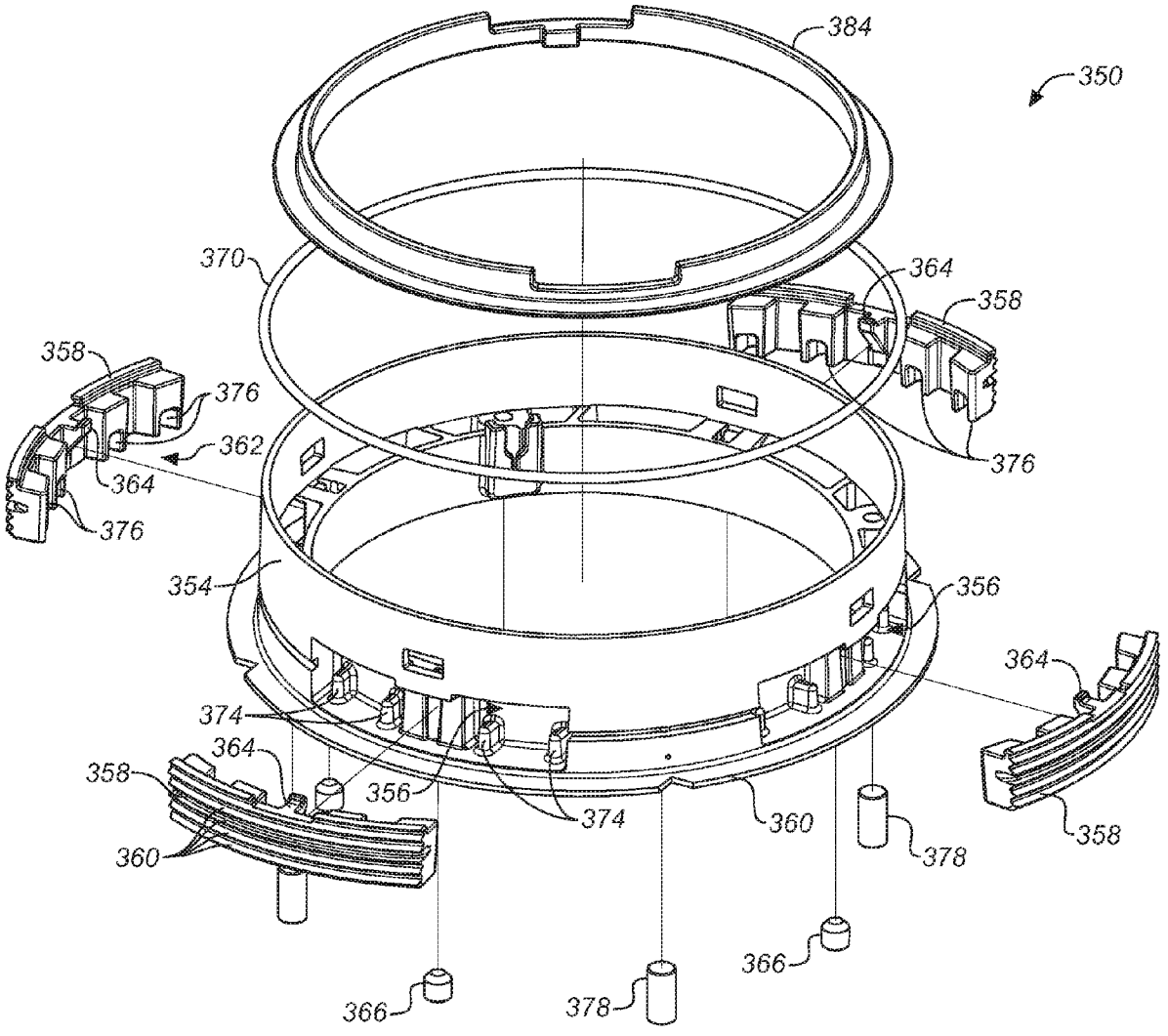
FIG. 7 is an exploded upper perspective view of the expansion ring and clamp assembly enabling affixation to a ceiling of effectively any thickness.
Figure 8A:
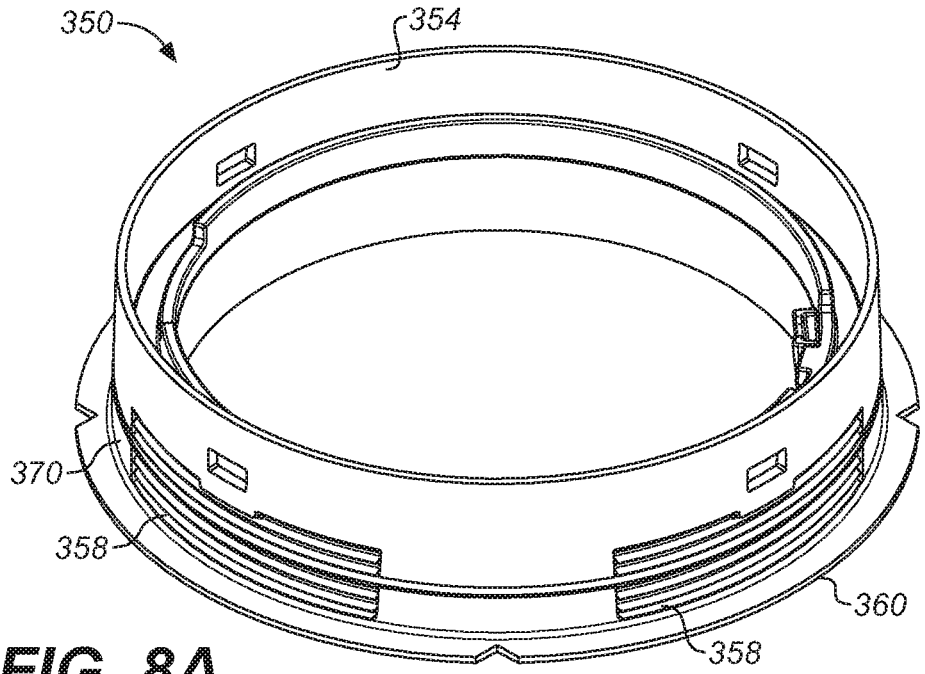
FIG. 8A is an upper perspective assembled view thereof showing the expansion ring and clamp sub assembly.
Figure 8B:
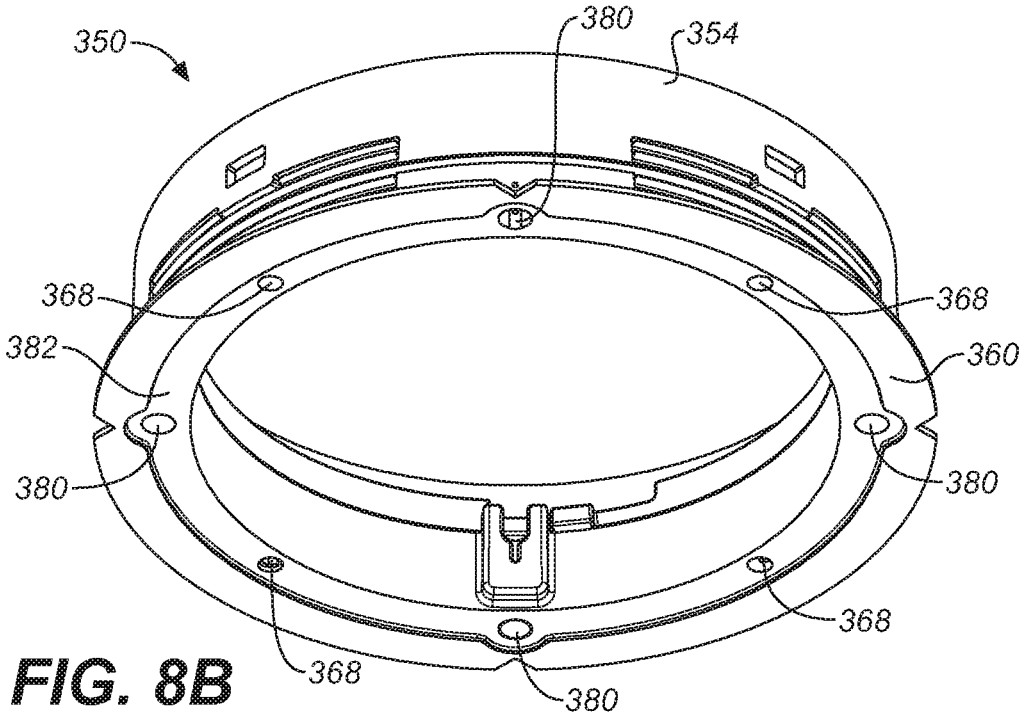
FIG. 8B is a lower perspective view thereof.
Figure 9A:
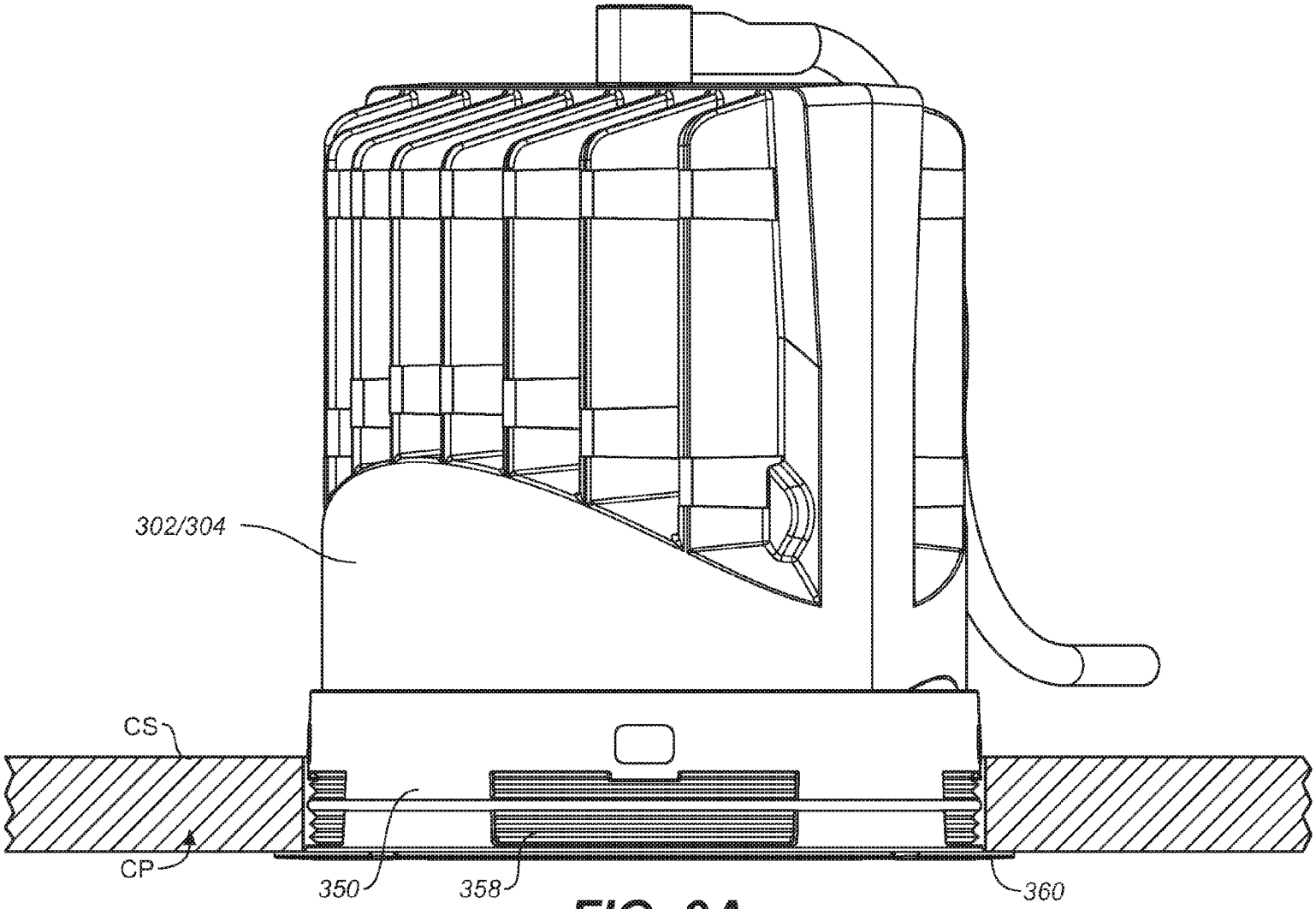
FIG. 9A is a partial side view in elevation showing the lower portion of the luminaire housing and expansion ring and clamp subassembly positioned for engagement with a ceiling substrate.
Figure 9B:
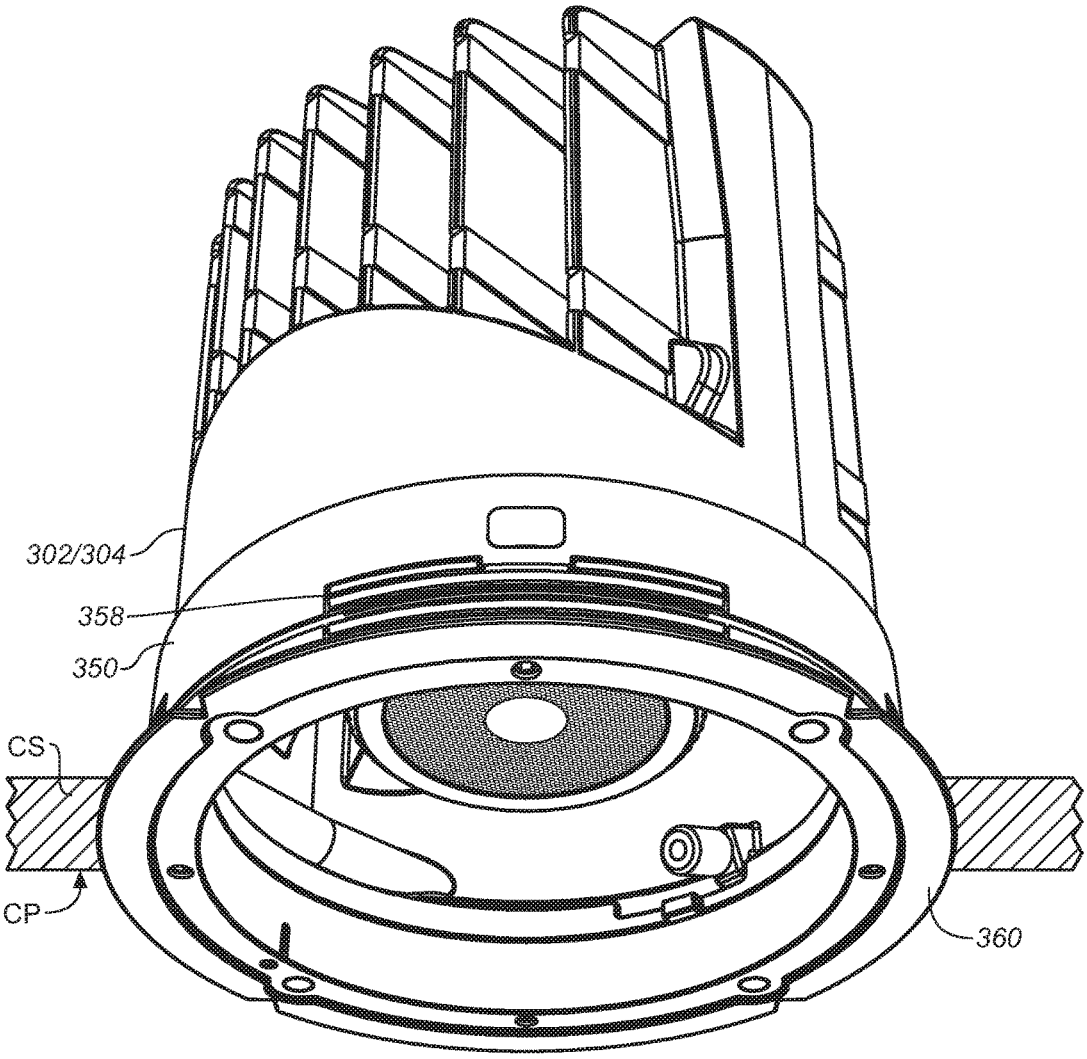
FIG. 9B is a lower perspective view showing an Allen wrench applied to the expansion ring to urge an expansion clamp into engagement with the ceiling substrate are part of the process of installing the luminaire housing.
Figure 9D:
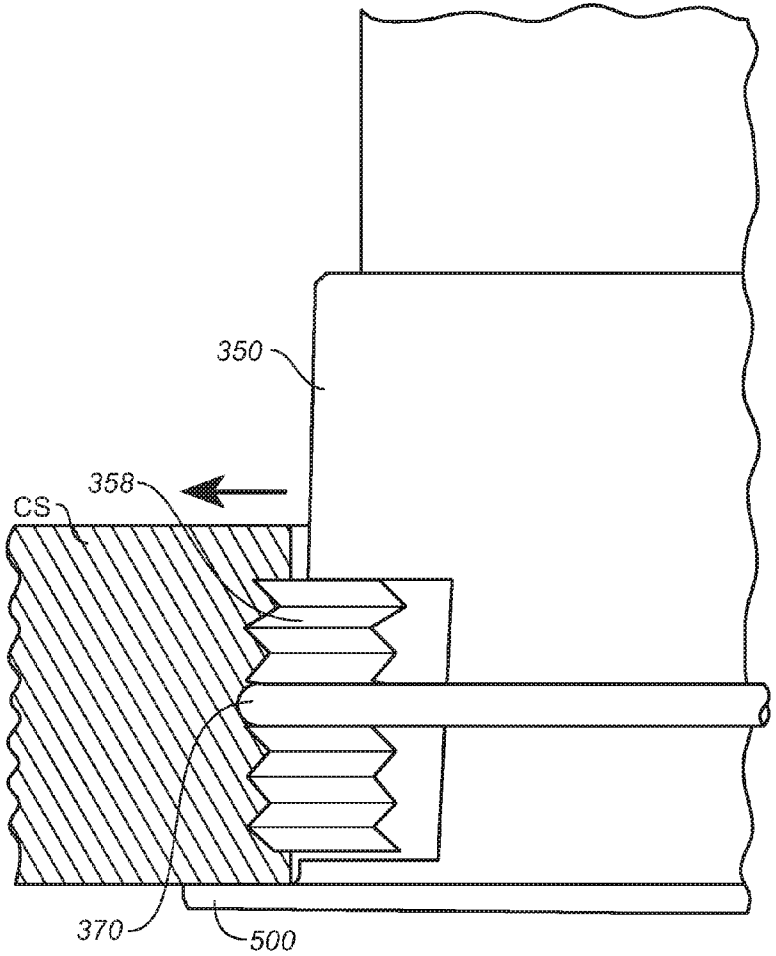
FIG. 9D is the same view showing the expansion clamp urged laterally into engagement with the ceiling substrate.
Figure 9C:
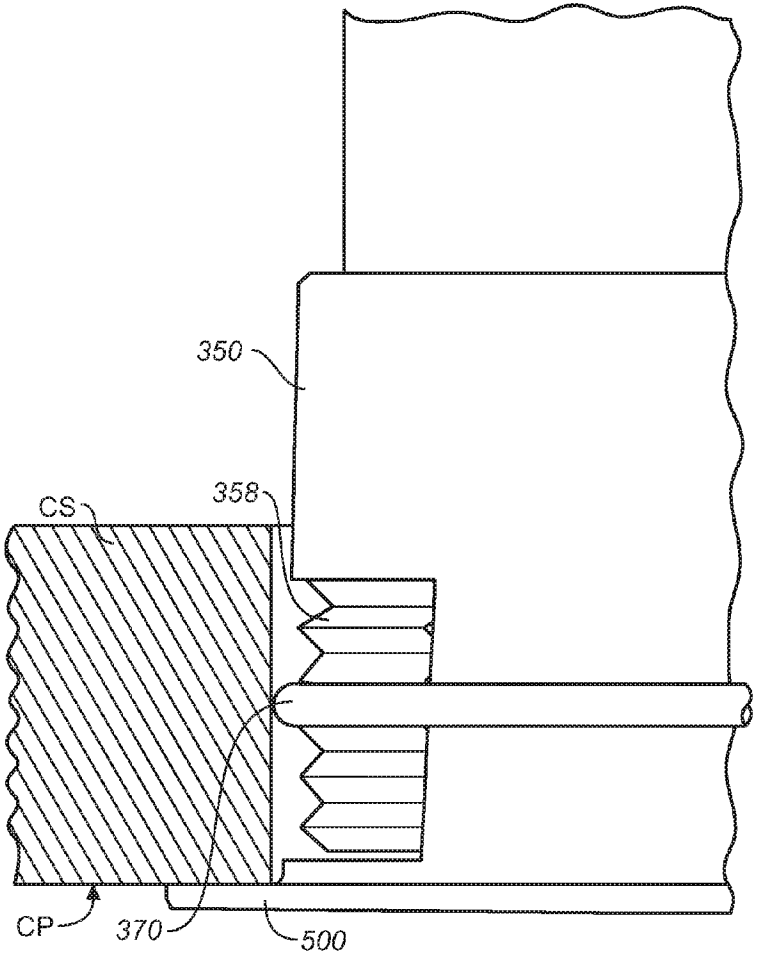
FIG. 9C is a detailed cross-sectional side view in elevation showing the operation of the expansion clamp.
Figure 10B:
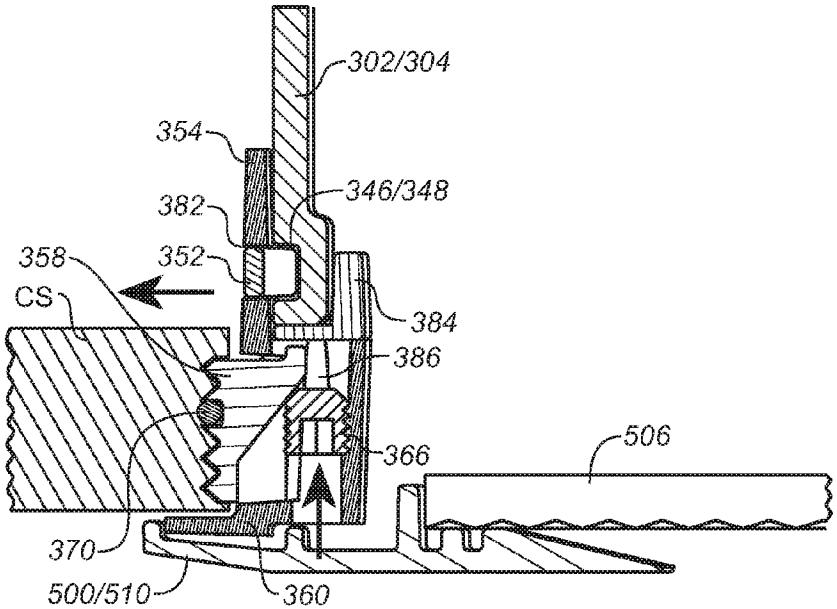
FIG. 10B is the same view showing the expansion clamp adjusted so as to engage the ceiling substrate.
Figure 10A:
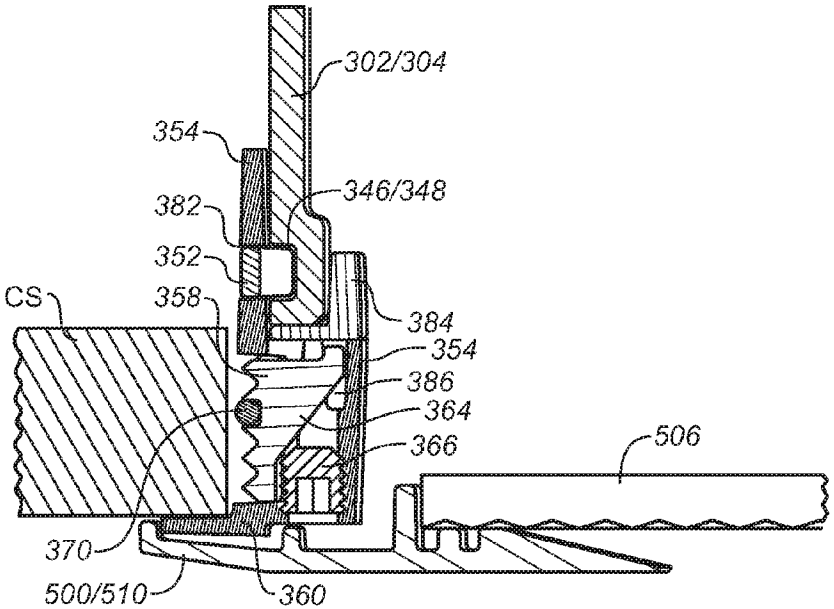
FIG. 10A is a partial detailed cross-sectional side view in elevation showing features of the expansion ring, expansion clamp, trim plate, and the lower portion of the housing before an expansion clamp is adjusted to engage the interior surface of the ceiling substrate cutout.
Figure 11B:
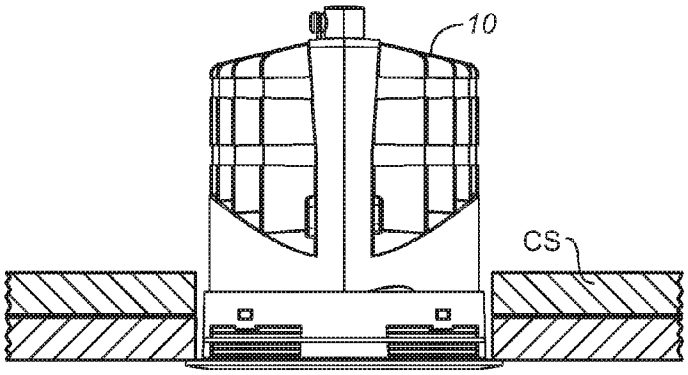
FIG. 11B is the same view showing the housing installed in a ceiling substrate having a thickness of 1 inch.
Figure 11D:
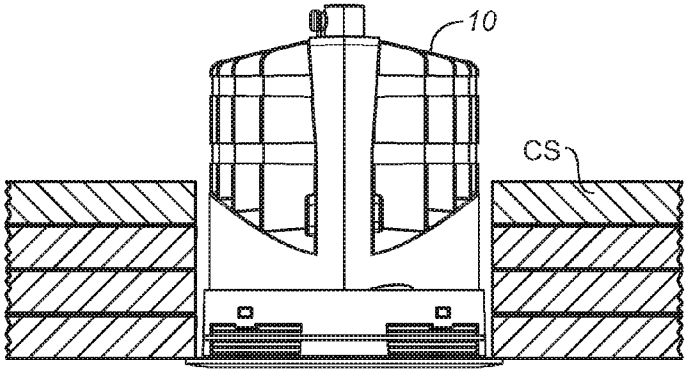
FIG. 11D is the same view showing the housing installed in a ceiling substrate having a thickness of 2 inches.
Figure 11A:
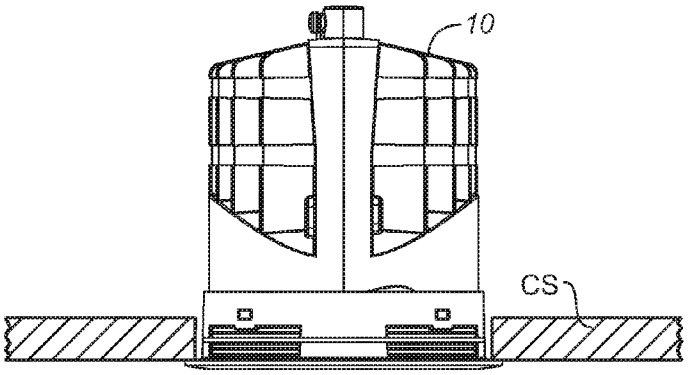
FIG. 11A is a side view in elevation showing the luminaire housing installed in a relative thin ceiling substrate of ½ inch in thickness.
Figure 11C:
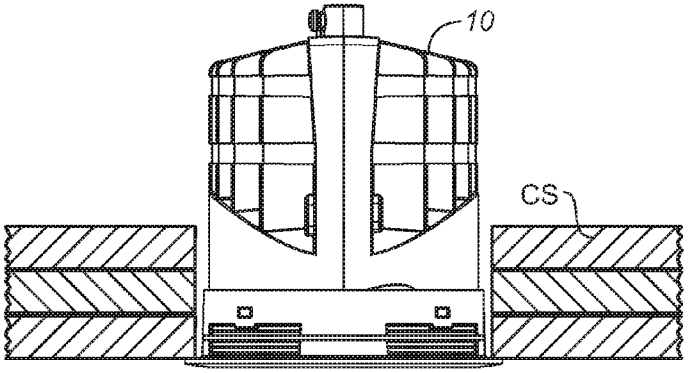
FIG. 11C is the same view showing the housing installed in a ceiling substrate having a thickness of 1½ inches in thickness.
Figure 12A:
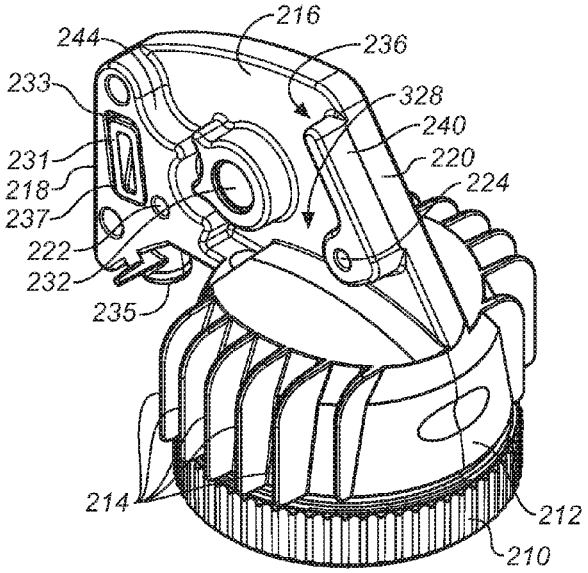
FIG. 12A is an upper front left perspective view showing the inventive lamp assembly.
Figure 12B:
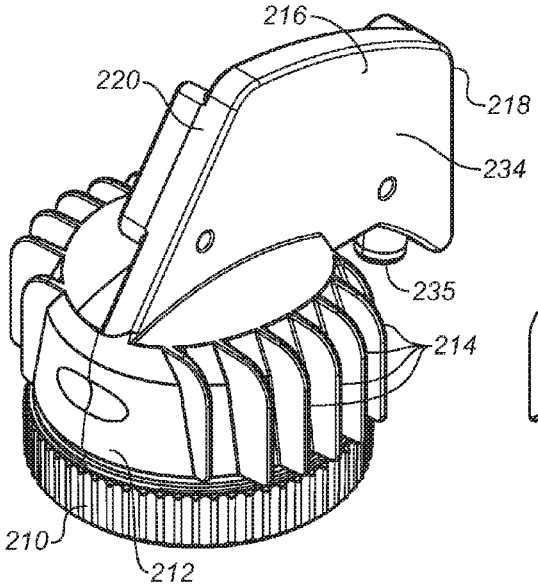
FIG. 12B is an upper front right perspective view thereof.
Figure 12C:
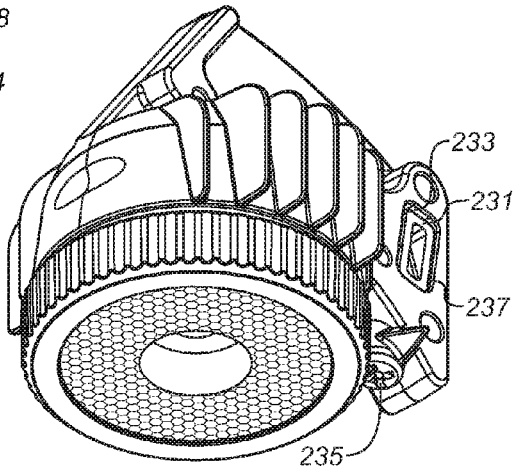
FIG. 12C is lower front right perspective view thereof.
Figure 13:
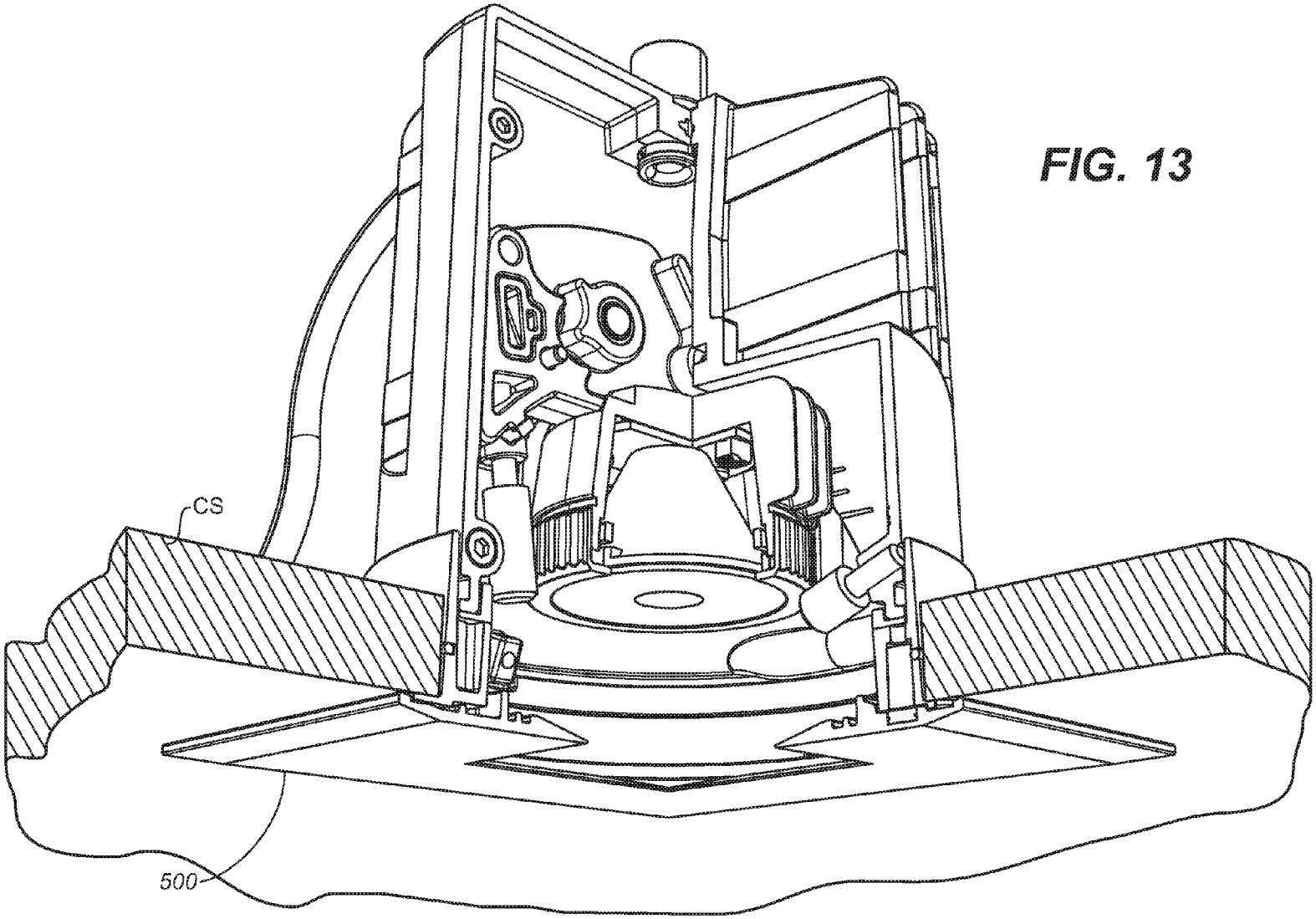
FIG. 13 is a lower cross-sectional view showing the interior of the luminaire when installed in a ceiling.
Figure 14:
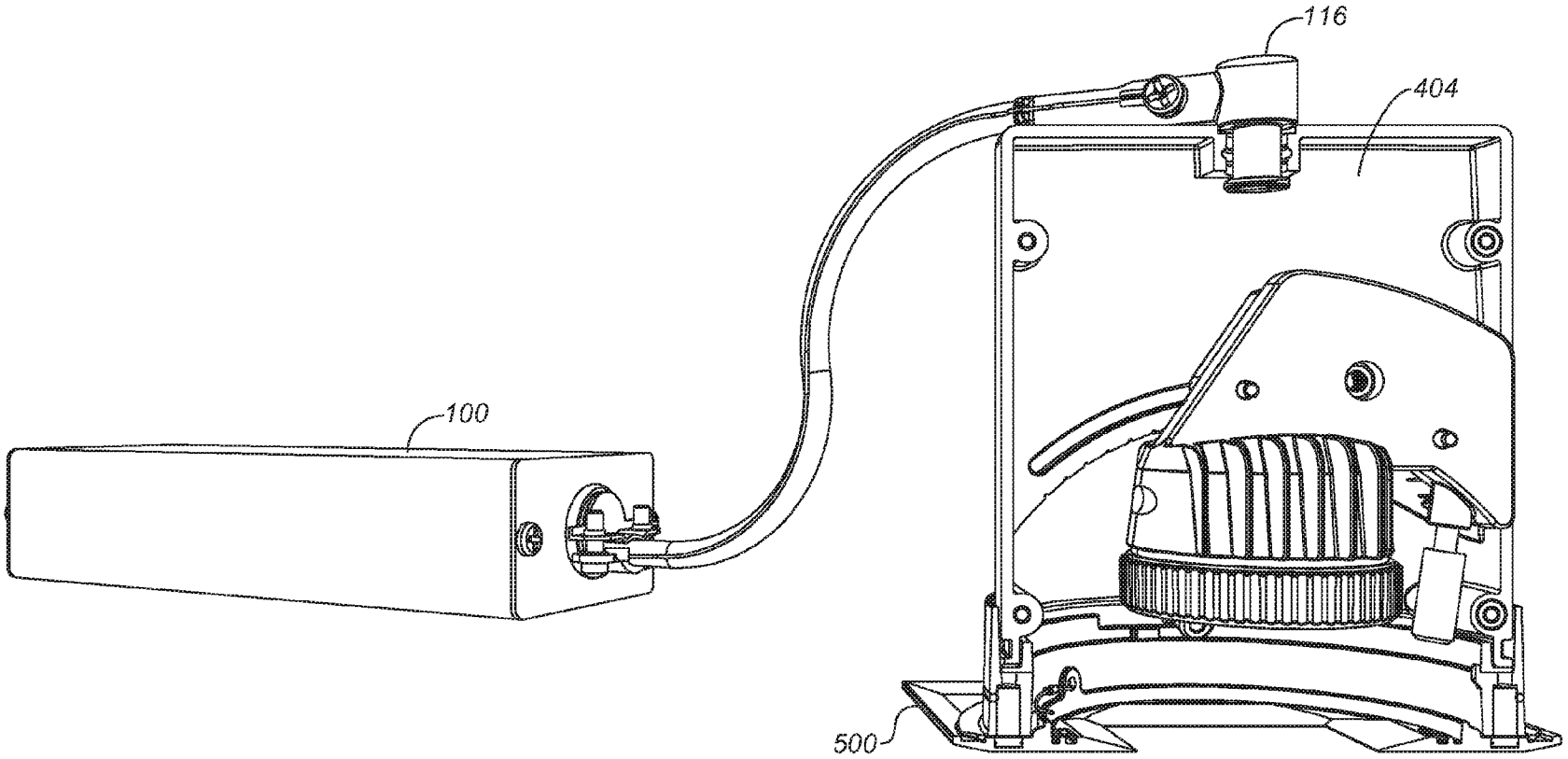
FIG. 14 is a cross-sectional side view in elevation showing half of the housing shell removed to reveal the lamp assembly adjustment and heat transfer structures.
Figure 15A:
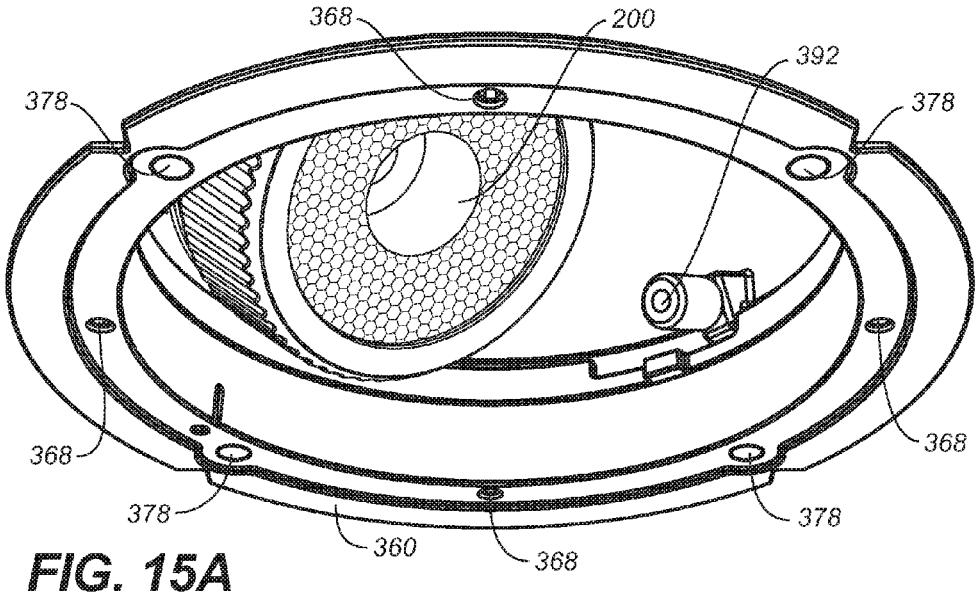
FIG. 15A is a lower perspective view showing the lamp fully tilted within the housing.
Figure 15B:
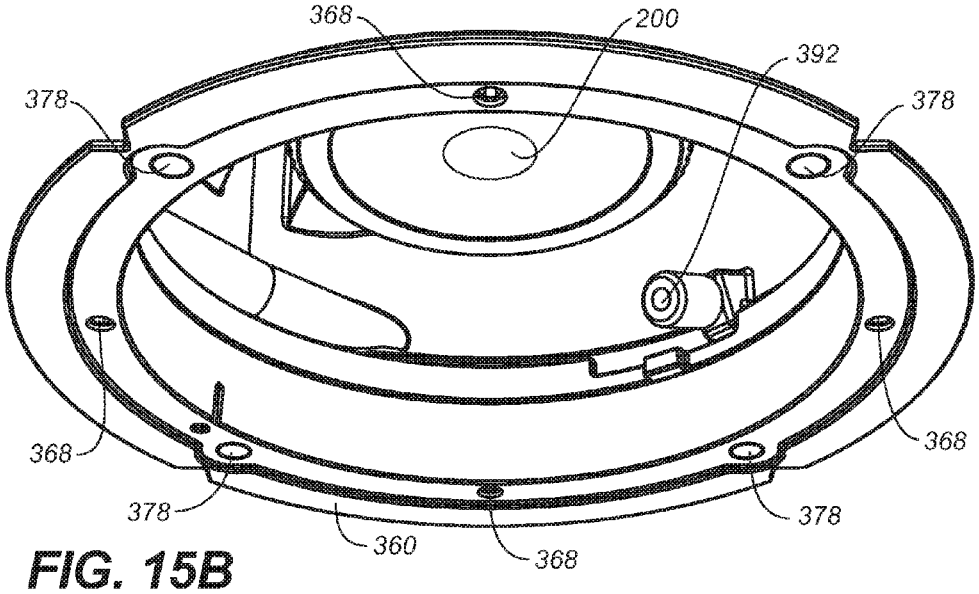
FIG. 15B is the same view showing the lamp oriented vertically (no tilt)

The luminaire next comprises a lamp assembly 200, which, in the most general terms, includes a lamp holder 202, a reflective conductor pin plate 204, a lens retainer 206, a total internal reflection (TIR) lens 208, and a lamp ring 210 which affixes to the lamp holder 202 to secure lamp elements 204 through 208 within the lamp holder body 212, which is a cup-shaped aluminum member having cooling fins 214. The lamp holder body is integrally formed with a heat conducting slide bar 216 having inwardly angled sides 218, 220, and two slide pin through holes 222, 224 for passage of slide pins 226, 228. A spring ball plunger 230 disposed in a recess or cup 232 maintains spacing between the slide bar and the opposing planar interior walls 404, 406 of the housing shell when assembled. The slide bar is secured in place at a desired tilt with a wedge 231 disposed in a recess 233 in the slide bar. The wedge can be urged against a heat sink wall in the housing above the slide pin track when a setscrew 235 is tightened into an inclined ramp on the lower portion 237 of the wedge. With this configuration, a user may reach into the open lower portion of the housing, loosen the setscrew, and move the lamp holder assembly to the desired angle, and then secure it in place simply by tightening the setscrew. The range of adjustment is physically constrained by the angled sides 218, 220 of the slide bar, which engage the interior side 305 of the housing shell 304 (esp. as shown in FIGS. 4C-4D).

The slide bar also includes a primary heat conducting flat side 234 and a contoured side 236, the latter including a cable stress relief channel 238 defined by a curved space between a first pin projection 240 for a slide pin 228, and a spring ball plunger boss 242 for the spring ball plunger cup 232. A second pin projection 244 may be provided for the other slide pin 226.

The housing 300 includes two housing halves or shells 302, 304, divided on a vertical plane to form semi-cylindrical bottom portions 306, 308, which combine to form a cylindrical bottom portion of the housing, and configured with any of a number of suitable shapes in an respective upper portions 310, 312, though shape continuity with the cylindrical lower portion is preferred. The two halves 302, 304, may be symmetrical and mirror images of one another, and include threaded mounting bosses 314, 316, 318, 320, and complementary through holes 322, 324, 326, 328, so that fasteners 330, 332, 334, 336 can be passed through the through hole in one half and threadably connected to the corresponding mounting boss in the other half, in a manner well known in the art.

The upper portions of the respective housing halves are configured to function as a heat sink and include extended surfaces, preferably fins 338, 340, which increase the surface area available for heat transfer.

At the lower edge 342, 344 of the bottom portions 306, 308, a semicircular channel 346, 348, becomes a continuous circumferential channel when the halves are fastened to together.

An expansion ring 350 fits around the cylindrical lower portion of the housing and is retained in place with retainer clips 352 that pass through apertures in the expansion ring and slidingly fit into the circumferential channel formed by semicircular channels 346, 348.

The expansion ring includes a cylindrical collar portion 354 having a plurality of evenly spaced apart ports 356 into each of which a laterally adjustable expansion clamp 358 is disposed. A circumferential flange 360 extends around the expansion ring to form a lower end. The expansion clamps are arcuate bars having exterior surface features 361, such as teeth, nubs, pins, or ribs, which provide bite when engaging a ceiling substrate surface CS.

On the interior side 362 of each of the expansion clamps, an upwardly angled ramp or wedge 364 is engaged by a pointed setscrew 366 disposed in a threaded hole 368, such that tightening the setscrew drives the expansion clamp outwardly and into the ceiling substrate material (see FIGS. 9A through 10B). A resilient O-ring 370 set in a circumferential groove 372 around the collar portion 354 of the expansion ring 350 circumscribes and generally holds the expansion clamps 358 in the plane of the collar surface until urged outwardly by a tightened setscrew. The stability and proper tracking of the expansion clamps as they move laterally within their respective ports is ensured by projections 374 disposed in the ports 356 which slide within channels 376 cut into the bottom edge of the expansion clamps. Thus, the expansion clamps do not twist as they move smoothly in the port opening, and they are urged back into the port as the setscrew 366 is loosened within its hole.

The expansion ring further includes spaced apart neodymium magnets 378, preferably cylindrical, set into holes 380 disposed around the lower edge 382 of the expansion ring 350.

Apertures 382 spaced around the expansion ring collar portion 354 accommodate the retainer clips which secure and stabilize the expansion ring around the circumferential channel created by channels 346, 348. An annular swivel ring 384 is placed on an interior ledge 386 in the expansion ring and is disposed between the lower edge 388, 390 of the housing halves 302, 304 and the expansion ring ledge 386. Accordingly, while the expansion ring is retained in place with retainer clips disposed in the circumferential channel surrounding the lower portion of the housing, the joined halves still swivel freely within the expansion ring. Free rotation of the housing within the expansion ring is prevented by set screws 392, 394, tightened through screw bosses 396, 398 molded into the interior sides 400, 402, of the housing halves 302, 304.

The heat sink upper portions of the housing halves each include a heat conducting planar wall 404, 406. Cut into each wall is a track 408, 410, which oppose one another when the housing halves are approximated and joined. When the halves are clamped together, the walls sandwich the heat conducting slide bar 216 of the lamp holder assembly 200, and the slide pins 226, 228 are slidingly disposed through the slide bar and into the opposing tracks 408, 410. The spacing between the planar walls of the housing halves provides an incidental clearance, such that spring ball plunger 230 is biased against one of the planar walls to urge the heat conducting flat side 234 of the slide bar 216 against the opposing planar walls, either 404 or 406. The contoured portion of the slide bar is thus closely approximated to the other heat sink wall. The slide bar and heat sink walls of the housing halves are preferably fabricated of materials having identical or very nearly identical thermal coefficients, such that there is an efficient conductive transfer of heat from the lamp assembly to the heat sink as the lamp assembly is heated by the powered lamp. Further, the slide bar is sized such that its angled sides 218, 220 are spaced apart from the interior sides of the housing. Thus, when moved through the range defined by the tracks 408, 410 into which the slide pins are disposed, the light may be moved smoothly through a predefined range to provide approximately 0-35 degrees of tilt.

Further, and referring now to both FIGS. 4C-4D and FIGS. 15A-15B, while the lamp assembly may be moved from a 0 degree tilt (FIG. 4C) wherein the center beam of the light is directed vertically downward, through 35 degrees of tilt (FIG. 4D), the light beam is not at all cut off or reduced in size by being shaded by the housing. Rather, its beam center remains fixed, and the lamp assembly rotates about a virtual axis PA throughout the X degrees range of tilt. Stated somewhat differently, the center point of the light beam never moves off center from the center of the aperture in the ceiling, such that no portion of the beam is ever cut off by either the housing or the ceiling itself. This contrasts dramatically with all known adjustable recessed light assemblies with a lamp assembly above the plane of the ceiling.

The top of each housing half 302, 304, includes a semi-cylindrical notch, 412, 414 having a medial channel 416, 418, which when the halves are joined creates the center cylindrical hole into which the coupling 117 of the conduit swivel 116 is pivotally disposed. The continuous medial channels capture the medial ring 119 of the coupling, allowing free rotation within the opening but which prevent excursion of the conduit swivel, thereby preventing electrical wires disposed through the conduit swivel from twisting or otherwise being put under strain. A gasket prevents any air from leaking through the cylindrical hole. When the free rotation of the housing within the expansion ring is combined with the tilting feature of the lamp assembly, the 35 degrees of vertical tilt is provided over a rotational range of 360 degrees.

Finishing the luminaire for positioning on the ceiling plane CP is a trim assembly, including a square or round trim plate 500, 510, respectively, each having a recess 502, into which the flange portion 360 of the expansion ring rests. The trim plate is either entirely ferromagnetic or includes ferromagnetic portions 504 or even magnets, polarized with respect to the magnets 378 disposed in the expansion ring. Thus, the trim plate is held in place entirely by magnets alone, making removal simply a matter of gently prying it apart from the flange portion of the expansion ring exposed under the ceiling.

An optional trim plate lens 506 may be placed over the trim plate opening if more diffused light is desired.

FIGS. 11A-11D show several advantages of the present invention. As can be seen, the luminaire can be installed and secured in a ceiling substrate CS having nearly any thickness, from as little as ¼ inch in thickness (FIG. 11A) through essentially any thickness (FIG. 11D as an example), as long as the power supply can positioned at a distance sufficient to allow the housing to swivel under the conduit swivel. The housing will still rotate freely within the ceiling opening, regardless of the ceiling thickness, and because the housing need not be tilted to adjust the direction of illumination, the full range of adjustments can be made without extending any portion of the light engine below the plane of the ceiling and without any disruption to insulation material above the ceiling.

Thus, from the foregoing it is seen that in an embodiment, and in a most essential aspect, the IC-rated airtight luminaire of the present invention includes a housing divided on a vertical plane to form two housing portions releasably coupled to one another to form an open cylindrical lower portion, a heat sink upper housing portion, and a heat conducting lamp assembly adjustment track enclosed within the housing. Disposed within the housing are heat sink walls slidably capturing a slide portion of a lamp assembly. A lamp holder integral with the slide bar includes a lens that directs a beam of light through an opening in a ceiling substrate in which the housing is installed, and an expansion ring rotatingly disposed around the open cylindrical lower portion of the housing engages and secures the housing in a ceiling substrate while also permitting the housing to freely turn within the expansion ring so as to allow adjustment of a beam of light directed from the lamp assembly.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An IC-rated airtight luminaire, comprising:

a housing divided on a vertical plane to form a first housing portion and a second housing portion, said first and second housing portions releasably coupled to one another to form an open cylindrical lower portion, a heat sink upper housing portion, and a heat conducting lamp assembly adjustment track enclosed within said housing and including first and second planar heat sink walls disposed in said first and second housing portions, respectively;

a lamp assembly slidably coupled to said lamp assembly adjustment track, said lamp assembly including a heat conducting slide bar slidably captured between said first and second planar heat sink walls, a lamp holder, and a lens which directs a beam of light through an opening in a wall or ceiling substrate in which said housing is installed; and an expansion ring rotatingly disposed around said open cylindrical lower portion, wherein said expansion ring engages and secures said housing in a wall or ceiling substrate while also permitting said housing to freely turn within said expansion ring so as to allow adjustment of a beam of light directed from said lamp assembly.

2. The IC-rated airtight luminaire of claim 1, wherein said expansion ring enables 360 degrees of rotation of said housing when installed so as to provide 360 of rotation.

3. The IC-rated airtight luminaire of claim 2, wherein said expansion ring is retained in place with retainer clips that pass through apertures in said expansion ring.

4. The IC-rated airtight luminaire of claim 1, wherein said lower housing portion includes a lower edge, a circumferential channel circumscribing said lower housing portion proximate said lower edge, and wherein said expansion ring fits around said channel.

5. The IC-rated airtight luminaire of claim 4, wherein said expansion ring includes a cylindrical collar portion having a plurality of spaced apart ports, and a laterally adjustable expansion clamp disposed in each of said ports.

6. The IC-rated airtight luminaire of claim 5, wherein said expansion clamps are arcuate bars having exterior surface features that provide engage a ceiling substrate surface.

7. The IC-rated airtight luminaire of claim 6, wherein each of said expansion clamps includes clamp adjustment apparatus to urge said clamp outwardly and into engagement with the ceiling substrate.

8. The IC-rated airtight luminaire of claim 7, wherein said clamp adjustment apparatus comprises upwardly angled wedge engaged by a setscrew disposed in a threaded hole, such that tightening said setscrew drives said expansion clamp outwardly and into the ceiling substrate.

9. The IC-rated airtight luminaire of claim 8, wherein said spaced apart ports include projections, and said expansion clamps include channels in which said projections slidingly fit, and further wherein the proper tracking of said expansion clamps as they move laterally within their respective spaced apart ports is ensured by said projections sliding within said channels in said expansion clamps.

10. The IC-rated airtight luminaire of claim 1, wherein said expansion ring includes a lower edge and spaced apart neodymium magnets set into holes disposed around said lower edge of said expansion ring.

11. The IC-rated airtight luminaire of claim 1, wherein said expansion ring includes an annular swivel ring rotatingly disposed on said expansion ring, such that while said expansion ring is retained in place on said lower portion of said housing, said housing swivels freely within said expansion ring, and further including set screws to lock said housing in place relative to said annular swivel ring.

12. The IC-rated airtight luminaire of claim 11, wherein said each of said planar heat sink walls include an arcuate groove and said slide bar includes a first slide pin on a first side of said slide bar and a second slide pin on a second side of said slide bar, said first and second slide pins slidingly disposed in one of said arcuate grooves, and a spring to urge said slide bar into engagement with one of said planar heat sink walls.

13. The IC-rated airtight luminaire of claim 12, wherein said slide bar and said planar heat sink walls are fabricated of materials having nearly identical thermal coefficients to facilitate and efficient conductive transfer of heat from said lamp assembly to said heat sink.

14. The IC-rated airtight luminaire of claim 13, wherein said slide bar moves through a range defined by said arcuate grooves into which said slide pins are disposed, wherein said light assembly may be moved to provide approximately 0-35 degrees of tilt.

15. The IC-rated airtight luminaire of claim 14, wherein said slide bar includes a primary heat conducting flat side and a contoured side including a cable stress relief channel to feed a power supply to a light in said lamp assembly.

16. The IC-rated airtight luminaire of claim 1, further including a conduit swivel pivotally but sealingly disposed in the center top of said housing, such that said housing freely rotates 360 degree under said conduit swivel, wherein rotation of said housing within said expansion ring combines with a tilting feature of said lamp assembly such that the degree of vertical tilt is provided over a rotational range of 360 degrees.

17. The IC-rated airtight luminaire of claim 1, further including a trim assembly having ferromagnetic features.

18. The IC-rated airtight luminaire of claim 1, wherein said housing rotates freely within a ceiling opening regardless of the ceiling thickness, and said lamp assembly may still be tilted through a full range of motion to adjust the direction of illumination without extending any portion of the lamp assembly below the plane of the ceiling or wall substrate and without any disruption to insulation material above the ceiling.

19. The IC-rated airtight luminaire of claim 18, wherein the center point of a beam of light directed from said lamp assembly never changes through the full range of tilt of said lamp assembly.

20. The IC-rated airtight luminaire of claim 1, further including a power assembly, including an LED driver enclosed in an inline junction box.

* * * * *